US007603953B2

(12) United States Patent
Imao et al.

(10) Patent No.: US 7,603,953 B2
(45) Date of Patent: Oct. 20, 2009

(54) CONVEYING APPARATUS

(75) Inventors: Shunichi Imao, Tokyo (JP); Akihiko Kosugi, Tokyo (JP); Tetsuo Ajimine, Gamo-gun (JP); Kazufumi Matsukawa, Gamo-gun (JP)

(73) Assignee: Sumco Corporation, Tokyo (JP)

( * ) Notice: Subject to any disclaimer, the term of this patent is extended or adjusted under 35 U.S.C. 154(b) by 140 days.

(21) Appl. No.: 11/486,934

(22) Filed: Jul. 13, 2006

(65) Prior Publication Data

US 2007/0012642 A1 Jan. 18, 2007

(30) Foreign Application Priority Data

Jul. 15, 2005 (JP) ..... P2005-206975

(51) Int. Cl.
*B61B 7/00* (2006.01)
*B61B 3/00* (2006.01)

(52) U.S. Cl. ..... 104/180; 104/172.4

(58) Field of Classification Search ..... 104/180, 104/172.4; 212/328
See application file for complete search history.

(56) References Cited

U.S. PATENT DOCUMENTS 509,758 A * 11/1893 Morgan et al. ..... 212/328
847,849 A * 3/1907 True ..... 212/328
884,595 A * 4/1908 Libby ..... 212/328
894,916 A * 8/1908 Strobel et al. ..... 212/328
1,000,537 A * 8/1911 Miller ..... 212/328
3,913,494 A * 10/1975 Coleson et al. ..... 104/172.4
4,570,543 A * 2/1986 Ishikura et al. ..... 104/300
5,634,407 A * 6/1997 Niederer ..... 105/150
5,690,031 A * 11/1997 Bach et al. ..... 104/168
6,220,626 B1 * 4/2001 Utsumi et al. ..... 280/733
6,227,994 B1 * 5/2001 Niki et al. ..... 474/153
6,554,127 B1 * 4/2003 Kroll ..... 198/465.4
6,814,218 B2 * 11/2004 Nishihara ..... 198/465.1
2003/0079967 A1 * 5/2003 Nishihara ..... 198/838
2007/0012642 A1 * 1/2007 Imao et al. ..... 212/328

FOREIGN PATENT DOCUMENTS

JP S63-123589 8/1988
JP H01-143715 10/1989

(Continued)

OTHER PUBLICATIONS

An Office Action from corresponding Japanese Patent Application No. 2005-206975, issued on Oct. 28, 2008, with English language translation.

*Primary Examiner*—S. Joseph Morano
*Assistant Examiner*—Jason C Smith
(74) *Attorney, Agent, or Firm*—Kolisch Hartwell, PC

(57) ABSTRACT

A conveying apparatus comprising a traveling unit which runs; a winding roller which is supported by the traveling unit; a belt which is wound on the winding roller so as to be unwound and wound by the winding roller; a pulley which has a peripheral surface guiding the belt and a diameter smaller than the diameter of the winding roller; and the pulley having no flange on both ends thereof; a belt positioning guide which is provided below the pulley and guides both edges of the belt in the win direction thereof so that the belt is positioned in the width direction; and a support unit which is attached to the belt and supports a conveyed object.

1 Claim, 5 Drawing Sheets

FOREIGN PATENT DOCUMENTS

| | | | | |
|---|---|---|---|---|
| JP | H01-286207 | | | 11/1989 |
| JP | H05-028814 | | | 2/1993 |
| JP | 08048486 | A | * | 2/1996 |
| JP | 08324969 | A | * | 12/1996 |
| JP | 11-011299 | | | 1/1999 |
| JP | 11011299 | A | * | 1/1999 |
| JP | 11334584 | A | * | 12/1999 |
| JP | 2003146205 | A | * | 5/2003 |

* cited by examiner

CONVEYING APPARATUS

BACKGROUND OF THE INVENTION

1. Field of the Invention

The present invention relates to a conveying apparatus in which an unit for supporting a conveyed object is suspended by a belt so as to be lifted and lowered by winding and unwinding the belt extending from a traveling unit for transportation.

Priority is claimed on Japanese Patent Application No. 2005-206975 filed Jul. 15, 2005, the content of which is incorporated herein by reference.

2. Description of Related Art

In a configuration of a conveying apparatus (conveyer) wherein an unit for supporting a conveyed object (load) is suspended by windable belts so as to be lifted and lowered by winding and unwinding the belts fed from a traveling unit for transportation provided with winding rollers for winding and unwinding the belts. A belt fed from the winding roller is guided by a guiding pulley at a fixed position and is suspended to a downward direction. At that state, the support unit is suspended at the end of the belts. Conventionally, in conveying apparatus of this type, for example, as disclosed in Japanese Unexamined Patent Application, First Publication No. Hei 11-11299, a flanged pulley that have flanges holding the belt from both width directional sides of the belt has been utilized as the guiding pulley for downwardly suspending the belt. In this case, in order to reduce size and weight of the conveying apparatus, and reduce costs, it is usual for the flanged pulley to be configured to have smaller diameter than the winding roller In a conventional configuration of the conveying apparatus that utilizes a flanged pulley as a guiding pulley for downwardly suspending the belt, dust is generated by wear of the belt at the position of the flanged pulley. Therefore, the conventional type conveying apparatus cannot be used in working environments requiring dust-free clean atmosphere, for example, in a clean room for semiconductor production.

In conveying apparatuses of this type, a flanged pulley having flanges that hold the belt from both width directional sides of the belt is also utilized as a winding roller for winding and unwinding the suspending belt. This winding roller has a large diameter because of requirement for winding a long length of a belt. On the other hand, in order to satisfy a demand for reducing cost, and for downsizing and weight saving the conveying apparatus, a flanged pulley as a guiding pulley for downwardly suspending the belt is usually configured to have as small a diameter provided that an overstress is not caused in the belt to be guided. In such a configuration, the circumferential speed of the guiding pulley is remarkably faster than the circumferential speed of the winding roller. Therefore, regarding a relative sliding rate between the flange and the side edge of the belt departing from the rotating body in the tangential direction, the relative sliding rate at a position of the guiding pulley is extremely higher than that at a position of the winding roller. Therefore, regarding a sliding friction causing generation of wear dust originated from side edges of the belt, sliding friction between the belt and the flanges of the winding roller scarcely or do not cause a wear dust, whereas a sliding friction between the belt and the flanges of the guiding pulley remarkably cause a generation of wear dust. As described-above, dust generation is considered to be an obstruction to the use of conveying apparatus in clean rooms. The present invention has an object of providing a conveying apparatus by which the above-described conventional problems can be solved.

SUMMARY OF THE INVENTION

In order to solve the above-described problem, a conveying apparatus of the invention comprises: a traveling unit which runs; a winding roller which is supported by the traveling unit; a belt which is wound on the winding roller so as to be unwound and wound by the winding roller; a pulley which has a peripheral surface guiding the belt and a diameter smaller than the diameter of the winding roller; and the pulley having no flange on both ends thereof; a belt positioning guide which is provided below the pulley and guides both edges of the belt in the width direction thereof so that the belt is positioned in the width direction; and a support unit which is attached to the belt and supports a conveyed object.

In the above-described conveying apparatus, the support unit may be suspended by a single belt, utilizing a winding roller, a guiding pulley and a belt positioning guide. Alternatively, the support unit may be suspended by a plurality of belts, utilizing a plurality of winding rollers, guiding pulleys, and belt positioning guides.

In a conveying apparatus of the above-described configuration, the belt positioning guide may comprise a bilateral pair of positioning rollers (left roller and right roller) which hold the belt from left side and right side of the belt.

The above-described bilateral pair of positioning rollers of the belt positioning guide may be provided with recessed grooves which engage with the side edges of the belt from left side and right side of the belt.

The recessed grooves of the bilateral pair of positioning rollers may be configured such that each groove is in contact with both thick-directional corners in a side edge of the belt, and a section of the groove has arc-like or V-like shape.

In any one of above-described configurations of the conveying apparatus, it is preferable that a surface portion of the belt positioning guide being in contact with the belt is composed of a synthetic resin.

In the above-described configuration of the conveying apparatus, the guiding pulley for downwardly suspending the belt is configured to be a pulley without flanges on both axial ends thereof. Therefore, even when the diameter of the pulley is reduced to a minimum value barely satisfying a necessity, there are no contact at which the rotor is mutually rubbing with the belt. Therefore, wear of the belt is substantially negligible. In conventional case, width directional movement (with directional drifting) of the suspending belt caused by misalignment of horizontal shaft of the guiding pulley or uneven surface smoothness of the both faces (front face and back face) of the belt cannot be controlled at a position of a guiding pulley. However, in the configuration of the invention, since a belt positioning guide for controlling a position of a belt is provided in a vicinity of the guiding pulley, the width directional movement of the belt at the position of the guiding pulley can be controlled to essentially the same degree as the conventional configuration in which a flanged pulley was used as the guiding pulley.

As is clear from the explanation above, by employing the configuration of the invention, down sizing of the conveying apparatus and cost reduction can be achieved without making the guiding pulley for downwardly suspending the belt to have a large diameter, in other words, while restricting the guiding pulley to have a diameter of a necessary minimum. At the same time, it is possible to solve the conventional problem of wear dust of the belt being generated at the position of the guiding pulley. In addition, width directional drifting of the belt can be controlled to the same degree as the conventional case in which a flanged pulley was used as the guiding pulley.

Therefore, the conveying apparatus of the invention can be advantageously used as a conveying apparatus used in a clean room.

The belt positioning guide is provided independently from the guiding pulley. If the belt positioning guide is configured by a bilateral pair of positioning rollers which hold the belt from the left side and right side of the belt, it is also possible to effectively suppress the generation of wear dust associated with the mutual rubbing between the belt and the belt positioning guide.

In this case, by providing the bilateral pair of positioning rollers as constituents of the belt positioning guide with recessed grooves which engage with the side edges of the belt from left and right sides of the belt, it is also possible to control the position of the belt in the direction of thickness, and inhibit the drifting of the belt in the direction of thickness, At that case, if the recessed grooves of the bilateral pair of positioning rollers are configured such that each groove being in contact with corners at the both ends in a thickness direction of the side edge of the belt, and the section of the groove has arc-like or V-like shape, the contact between the belt and the recessed grooves of the bilateral pair of positioning rollers can be made a point contact, or a state close to it. Consequently, the generation of wear dust from the belt caused by mutual rubbing between the belt and the recessed grooves of the rotor can be effectively inhibited.

In any case, by employing a configuration wherein the contact face between the belt positioning guide and the belt is made of a synthetic resin, the frictional coefficient of the surface of the belt positioning guide being in contact with the belt is reduced, thus suppressing wear of the belt, and even more effectively suppressing the generation of wear dust.

DETAILED DESCRIPTION OF THE INVENTION

Figure 1:
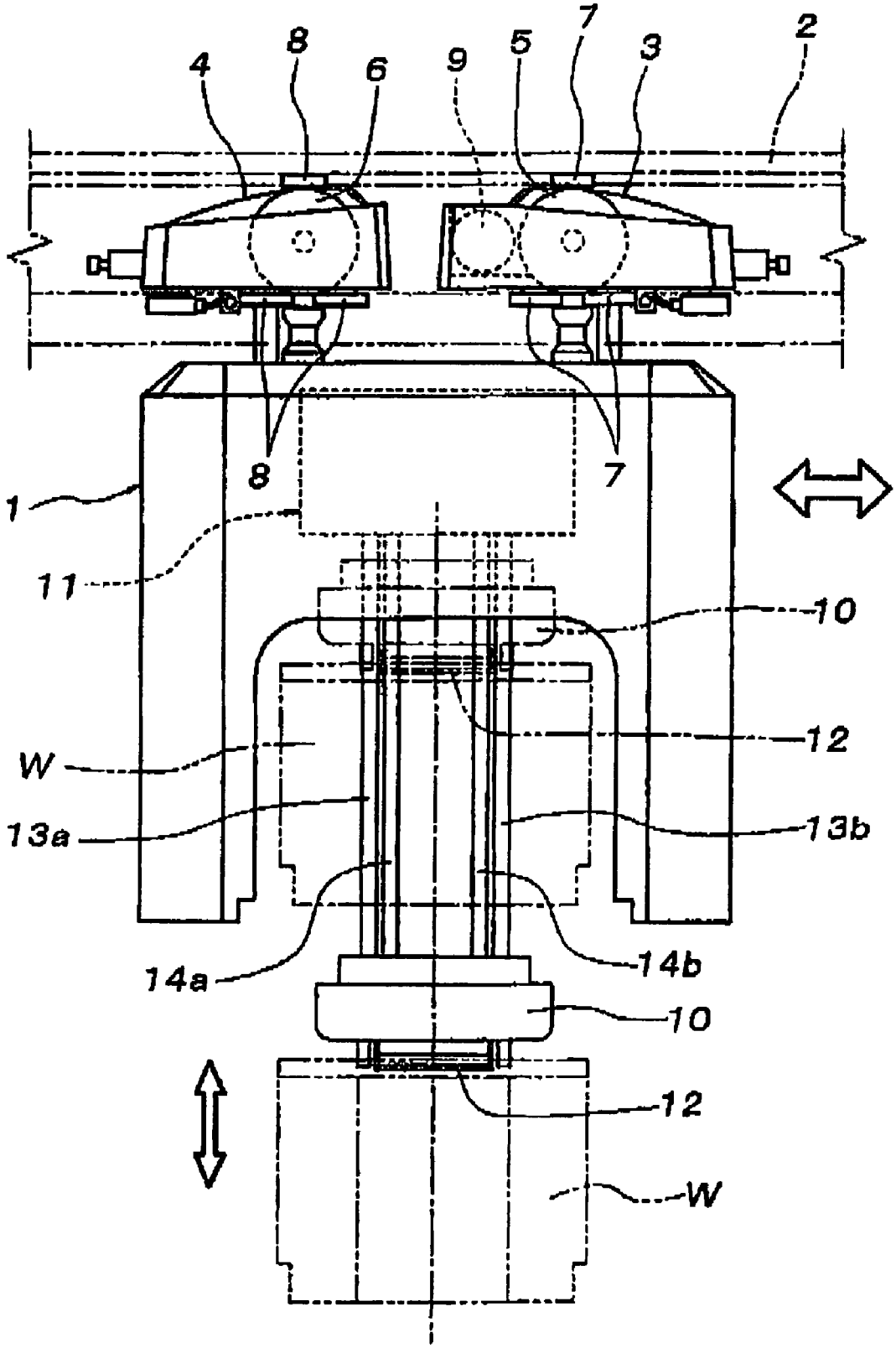
FIG. 1 is a side view of the overall conveying apparatus.
Figure 2:
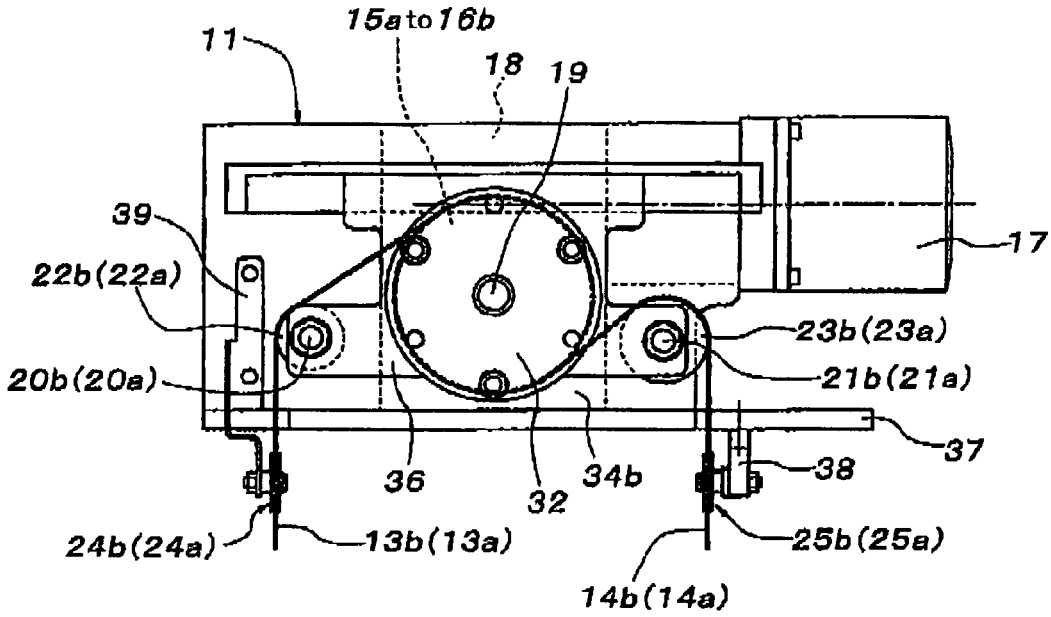
FIG. 2 is a front view of the vertical-drive suspending unit.

Hereunder, specific embodiments of the present invention are explained based on the attached drawings. In FIG. 1, reference symbol 1 denotes a train type traveling unit for transportation of a conveyed object. The traveling unit 1 is suspended from guide rails 2 by a power trolley unit 3, and a flee trolley unit 4 such that the traveling unit 1 can runs along the rails 2. The trolley units 3 and 4 are furnished with horizontal axis wheels 5 and 6 for traveling, and perpendicular as rollers 7 and 8 as steady rests. The horizontal axis wheel 5 of the power trolley unit 3 is rotated by a motor 9 mounted on the power trolley unit 3.

On the traveling unit 1 is provided therebelow, a vertical dive suspending unit (elevating unit) 11 which suspends the support unit 10 such that it is able to be lifted and lowered. Although a support unit exemplified in FIG. 1 is provided with a gripping device 12 which can be opened and closed for gripping an upper portion of a conveyed object W, the support unit 10 may have various configurations in accordance with the shape of the conveyed object W, or the like.

As shown in FIG. 2 to FIG. 6, a vertical-drive suspending unit 11 suspends four positions at front, back, left, and right, of the support unit 10 by four belts 13*a*, 13*b*, 14*a*, and 14*b*. Width directions of the four belts 13*a*, 13*b*, 14*a*, and 14*b* are oriented parallel to the travel direction of the traveling unit 1. The vertical-drive suspending unit is furnished with winding rollers 15*a*, 15*b*, 16*a*, and 16*b* for winding and unwinding the belts 13*a*, 13*b*, 14*a*, and 14*b*. These four winding rollers 15*a*, 15*b*, 16*a*, and 16*b*, are coaxially arranged such that they are lined up in the running direction of the traveling unit 1. At that state, the winding rollers 15*a* and 15*b* for winding and unwinding a front-back pair of belts 13*a* and 13*b* on one side (right side or left side) are positioned on the outer side of the winding rollers 16*a* and 16*b* for winding and unwinding the front-back pair of belts 14*a* and 14*b* on the other side. Specifically, the winding millers 15*a*, 15*b*, 16*a* and 16*b* are attached on a drive shaft 19 of a motor 17 fitted with a speed reducer. The drive shaft 19 protrudes in the front and back directions from the speed reducer 18, and winding rollers 16*a* and 15*a*, and the winding rollers 16*b* and 15*b* are arranged on both the front and back sides of a speed reducer 18. The winding rollers 15*a* to 16*b* comprise flanged pulleys. Four respectively individual pulleys may be individually installed on the drive shaft 19. However, in this embodiment, winding rollers 16*a* and 15*a*, and 16*b* and 15*b*, on both the front and back sides of the speed reducer 18 are configured to have an integral construction in which the intermediate flange is shared by two adjacent winding rollers.

The winding direction of the belts 13*a*, 13*b*, 14*a* and 14*b* with respect to the winding rollers 15*a*, 15*b*, 16*a* and 16*b* is the same. Flangeless guiding pulleys 22*a* and 22*b* are supported by support shafts (support shafts) 20*a* and 20*b*, which are parallel with the drive shaft 19, such that they are adjacent to the belt extending side of the two winding rollers 15*a* and 15*b*. The belts 13*a* and 13*b*, extending from the upper side of the outer winding rollers 15*a* and 15*b* are suspended spanning the flangeless guiding pulleys 22*a* and 22*b*. Flangeless guiding pulleys 23*a* and 23*b* are supported by support shafts 21*a* and 21*b*, which are parallel with the drive shaft 19, such that they are adjacent to the belt extending side of the two winding rollers 16*a* and 16*b*. The belts 14*a* and 14*b* extending from the bottom side of the inside winding rollers 16*a* and 16*b* are suspended spanning the flangeless guiding pulleys 23*a* and 23*b*. These guiding pulleys 22*a*, 22*a*, 23*a* and 23*b* may have the same width as the width of the belts 13*a*, 13*b*, 14*a*, and 14*b*. Preferably, the guiding pulleys 22*a*, 22*a*, 23*a* and 23*b* may have a width properly wider than the width of the belts 13*a*, 13*b*, 14*a*, and 14*b*.

In the above-described configuration, the guiding pulleys 22*a* to 23*b* are smaller in diameter than the winding rollers 15*a*, 15*a*, 16*a* and 16*b*. The minimum diameter of the guiding pulleys 22*a*, 22*b*, 23*a* and 23*b* is determined based on the range in which an undesirable bending stress does not act on the belts 13*a*, 13*b*, 14*a*, and 14*b* when the guiding pulleys 22*a*, 22*b*, 23*a* and 23*b* change the directions of the belts 13*a*, 13*b*, 14*a*, and 14*b*. In the embodiment of the present invention shown in the figures, the guiding pulleys 23*a* and 23*b*, which bend the belts 14*a* and 14*b* in a S-like shape, are made to be larger in diameter than the other guiding pulleys 22*a* and 22*b*. By such a configuration, without providing additional guiding pulleys on the guiding pulley 22*a* and 22*b* side, it is possible to control the difference between the length of the belts 15*a* and 15*b* wound by the winding rollers 15*a* and 15*b* and the length of the belts unwound by the winding rollers 16*a* and 16*b* to a value within a range in which a substantial adverse effect does not arise. In other words, the diameters of guiding pulleys 23*a* and 23*b* are larger than the diameters of the guiding pulleys 22*a* and 22*b* such that, when the whole lengths of the belts 13*a* to 14*b* are completely unwound from the winding rollers 15*a* to 16*b*, all of which having same diameters of circumference surface for winding, the belts 13*a* and 13*b* extending from the winding rollers 15*a* and 15*b*, and the belts 14*a* and 14*b* extending from the winding rollers 16*a* and 16*b*, nearly show a point symmetry about the drive shaft 19.

Figure 7:
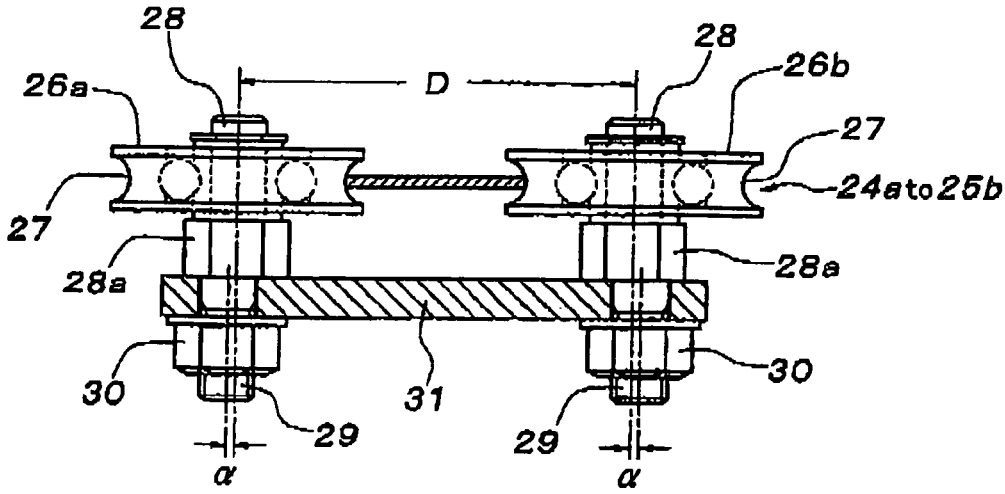
FIG. 7 is a partial cross-sectional plan view showing a specific configuration of the belt positioning guide.

Belt positioning guides 24*a*, 24*b*, 25*a* and 25*b* are installed in the vicinity of the guiding pulleys 22*a*, 22*b*, 23*a* and 23*b*. At positions below the guiding pulleys 22*a*, 22*b*, 23*a* and 23*b*, the belts 13*a*, 13*b*, 14*a* and 14*b* suspended from the guiding pulleys are positioned in relation to the belt width direction by the belt positioning guides 24*a*, 24*b*, 25*a* and 25*b*. The belt positioning guides 24*a*, 24*b*, 25*a* and 25*b* of this embodiment are configured by bilateral (left and right) pairs of positioning rollers 26*a* and 26*b*, which hold the respective belts 13*a*, 13*b*, 14*a* and 14*b* from left and right width directional sides of the belts. To explain in further detail, as shown in FIG. 7, the left and right pain of rollers 26*a* and 26*b* comprise grooved rollers of a synthetic resin which are furnished with arc-shaped recessed grooves 27 in their circumferences. The recessed grooves 27 are respectively in contact with thick-directional corners in the side edge of the belts 13*a*, 13*b*, 14*a* and 14*b*. In each one of the belt positioning guides 24*a*, 24*b*, 25*a* and 25*b*, support shafts 28 of the bilateral pairs of rollers 26*a* and 26*b* are supported on a bearing plate 31 in cantilever state by a fastening nut 30, and an screw shaft 29. The screw shaft 29 is integrated with the inner end of the support shaft 28 and is biased by an eccentricity $\alpha$ with respect to the support shaft 28. Reference symbols 28*a* denote a holding nut portion that is integrally formed on the support shafts 28. While the positioning rollers 26*a* and 26*b* were explained to be grooved rollers made of a synthetic resin in the above-described embodiment, it should be noted that the rotors 26*a* and 26*b* may be made of other materials, provided that the peripheral annular portions which form the recessed grooves being in contact with the belts 13*a*, 13*b*, 14*a* and 14*b* are made of a synthetic resin.

When the belt positioning guides 24*a*, 24*b*, 25*a* and 25*b* have the above-described configuration, by relaxing the fastening nut 30 and by rotating the support shaft 28 about the central axis of the eccentric screw shaft 29 via the holding nut portion 28*a*, the position of the rollers 26*a* and 26*b* can be moved within a range of twice the eccentricity $\alpha$ in the width direction of the belts 13*a*, 13*b*, 14*a* and 14*b* which are respectively held between two rollers 26*a* and 26*b*. Accordingly, by adjusting the position of the rollers 26*a* and 26*b* as mentioned above, the position of the belts 13*a*, 13*b*, 14*a* and 14*b*, which are respectively held between two rollers 26*a* and 26*b*, can be fine tuned in the width direction thereof, and the spacing D between respective pairs of two rollers 26*a* and 26*b* can be fine tuned. Following this fine tuning, by tightening the fastening nut 30 in a state where the support shaft 28 is fixed through the holding nut portion 28*a*, the support shaft 28 (the rollers 26*a*, 26*b*) can be fixed to the bearing plate 31.

Figure 3:
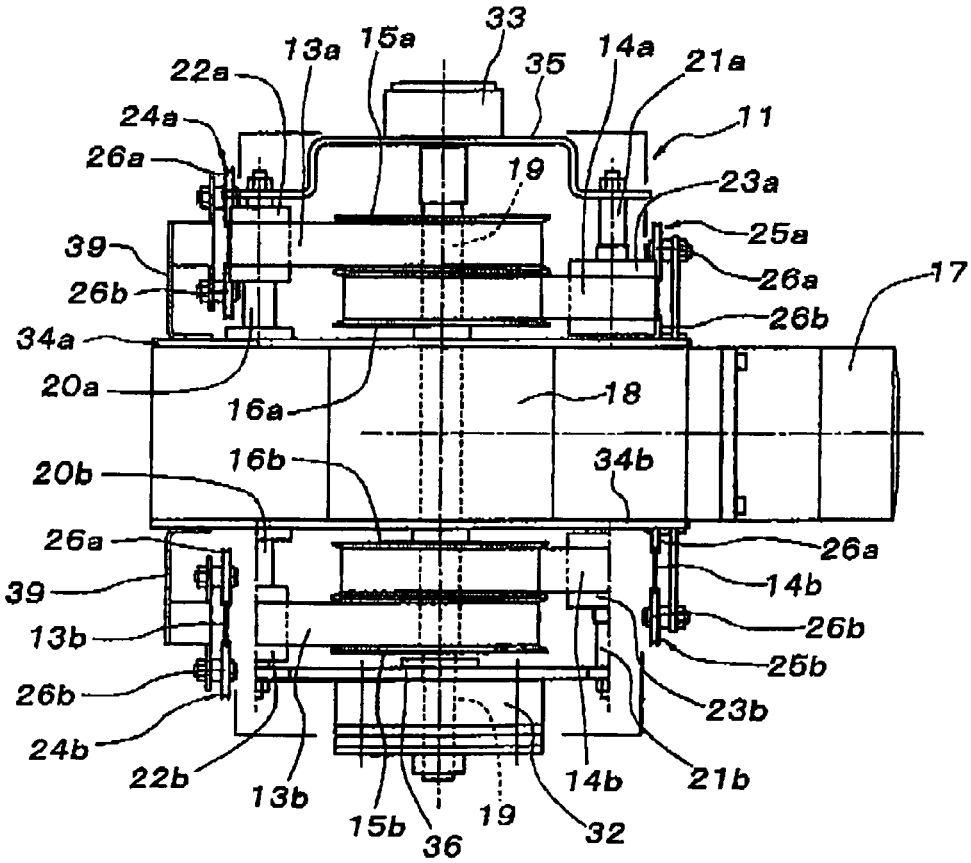
FIG. 3 is a plan view of the vertical-drive suspending unit.
Figure 4:
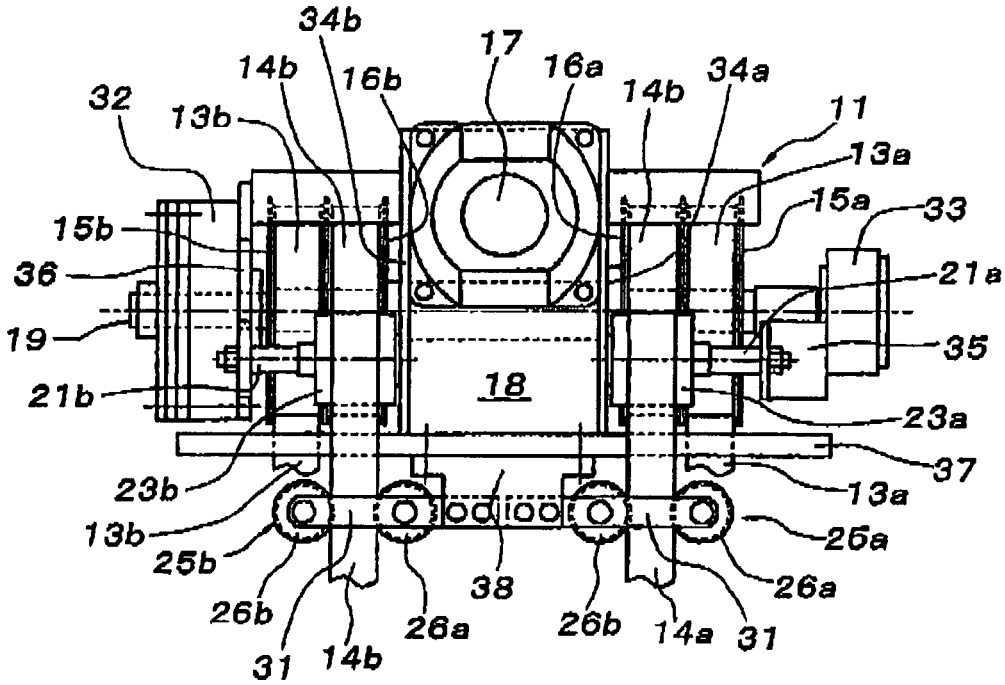
FIG. 4 is a right side view of the vertical-drive suspending unit.
Figure 5:
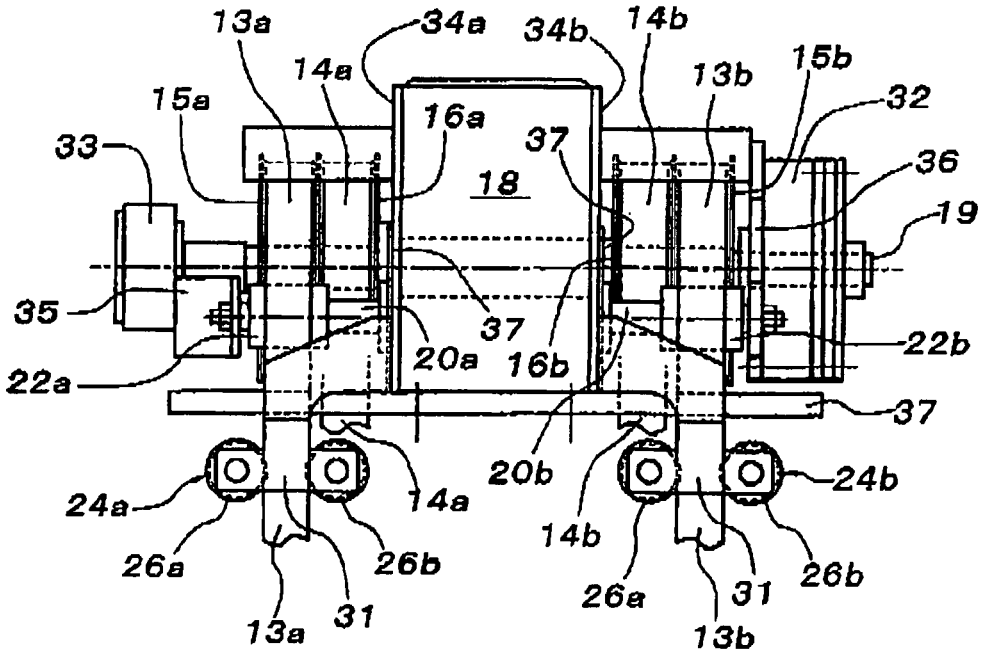
FIG. 5 is a left side view of the vertical-drive suspending unit.
Figure 6:
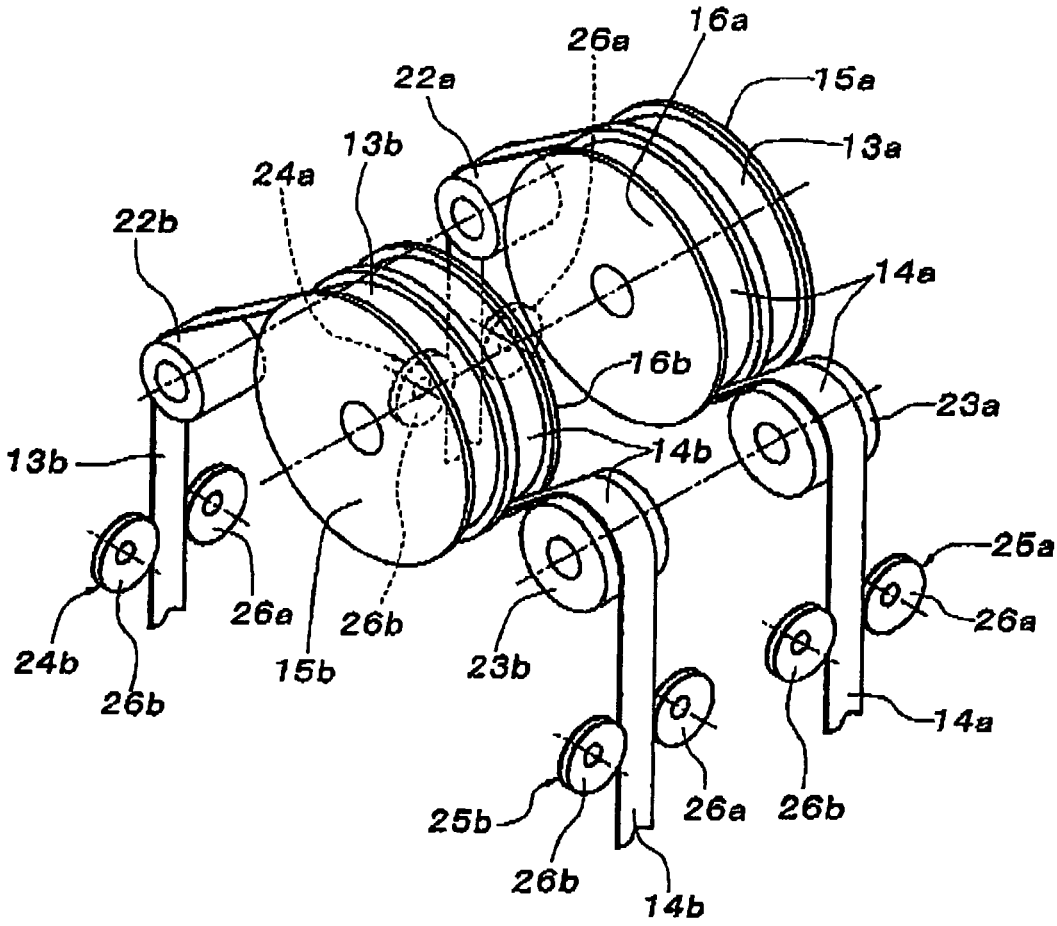
FIG. 6 is a perspective view showing the belt, the winding roller, the guiding pulley, and the belt positioning guide.

As shown in FIG. 3, an electromagnetic brake 32 is installed on one end of the drive shaft 19. Moreover, on the other end of the drive shaft 19 is installed a slip ring device 33. Metallic wires may be embedded in the belts 13*a*, 13*b*, 14*a* and 14*b* along the length direction of the belts as reinforcements. The reinforcement metallic wire of at least one belt may be utilized as an electrical supply wire to, for example, a motor that drives the holding device 12 of the support unit 10, and the like. In such a case, the slip ring device 33 may be used as a current collector. Accordingly, the support shafts 20*a* and 21*a* of the guiding pulleys 22*a* and 23*a* for guiding the belts 13*a* and 14*a* can be installed between a side plate 34*a* which is positioned on one side of the speed reducer 18, and a support plate 35 which supports the slip ring device 33 for current collection. The support shafts 20*b* and 21*b* of the guiding pulleys 22*b* and 23*b* for guiding the belts 13*b* and 14*b* can be installed between a side plate 34*b* which is positioned on the other side of the speed reducer 18, and a support plate 36 which supports the electromagnetic brake 32. Furthermore, a mounting plate 39 is connected to the bearing plate 31 of the belt positioning guides 24*a* and 24*b* towards the upper inside direction. By utilizing this mounting plate 39, the belt positioning guides 24*a* and 24*b* can be installed on the side plates 34*a* and 34*b*. The belt positioning guides 25*a* and 25*b* can be installed by bolting the bearing plate 31 thereof to a mounting plate portion 38 which is installed on the bottom side of a base plate 37 that supports the speed reducer 18.

In accordance with the above-described configuration of the vertical-drive suspending unit 11, lifting and lowering process of the support unit can be explained as follows. When the belts 13*a*, 13*b*, 14*a* and 14*b* are completely wound up by the winding rollers 15*a*, 15*b*, 16*a*, and 16*b*, the support unit 10 is positioned at a ceiling position represented by the imaginary line (two-dot chain line) in FIG. 1. By releasing the electromagnetic brake 32, forward-driving the drive shaft 19 by operating the motor 17 fitted with a speed reducer, and by turning the four winding rollers 15*a*, 15*b*, 16*a* and 16*b* in the belt unwinding direction, the belts 13*a*, 13*b*, 14*a* and 14*b* are fed by a gravitational force acting on the support unit 10 suspended by the belts, and the support unit 10 is lowered. At a point of time at which the support unit 10 has been lowered to a predetermined level, the motor 17 fitted with a speed reducer is stopped, the electromagnetic brake 32 is operated, and the winding rollers 15*a*, 15*b*, 16*a* and 16*b* are stopped. After that, the loading or unloading of the conveyed object (load) may be performed with respect to the support unit 10.

For lifting the support unit 10 which has been lowered to the ceiling position represented by the imaginary line (two-dot chain line) in FIG. 1, the electromagnetic brake 32 is released, the drive shaft 19 is reverse-driven by operating the motor 17 fitted with a speed reducer, the four winding rollers 15*a*, 15*b*, 16*a* and 16*b* are turned in the belt winding direction, thereby winding the belts 13*a*, 13*b*, 14*a* and 14*b* by the winding rollers 15*a*, 15*b*, 16*a* and 16*b*, and the support unit 10 which is suspended by the belts 13*a*, 13*b*, 14*a* and 14*b* can be lifted to the ceiling position.

In the above-described manner, by the winding and unwinding operations of the belt 13*a*, 13*b*, 14*a* and 14*b*, the support unit 10 can be lifted and lowered with respect to the traveling unit 1.

Figure 8:
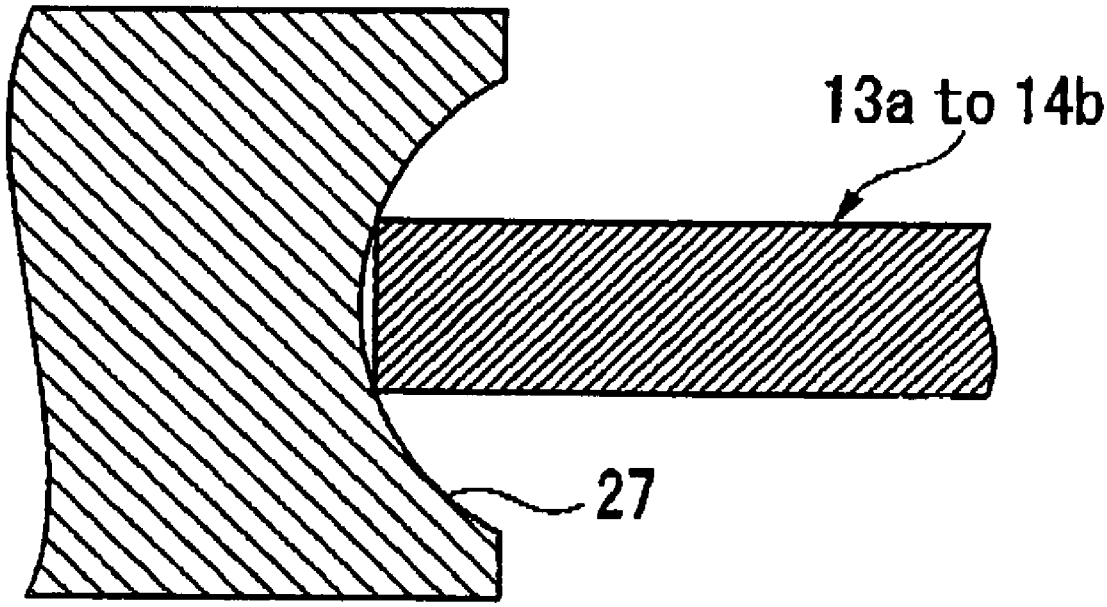
FIG. 8 is a schematic cross-sectional view showing a state of point contact between the positioning roller of belt positioning guide and the belt.

At that time, the width directional positions of the belts 13*a*, 13*b*, 14*a*, and 14*b* are respectively restricted by the recessed grooves 27 of the left and right pair of positioning rollers 26*a* and 26*b* of the belt positioning guides 24*a*, 24*b*, 25*a* and 25*b*. Therefore, the belts 13*a*, 13*b*, 14*a*, and 14*b* do not move in the width direction on the surfaces of the guiding pulleys 22*a*, 22*b*, 23*a* and 23*b*, irrespective of the guiding pulleys 22*a*, 22*b*, 23*a* and 23*b* not having flanges for restricting the width directional positions of the belts. Furthermore, as shown in FIG. 7 and FIG. 8, the belts 13*a*, 13*b*, 14*a* and 14*b* are in contact with the recessed grooves 27 of the left and right pair of positioning rollers 26*a* and 26*b*, in an approximate point contact condition in which both thick-directional corners in the side edge of the belts 13*a*, 13*b*, 14*a* and 14*b* are in contact with the recessed grooves 27. Therefore, along with making the rotors 26*a* and 26*b* of a synthetic resin, the wear of the belts 13*a*, 13*b*, 14*a* and 14*b* can be suppressed, and also the belts 13*a*, 13*b*, 14*a* and 14*b* can be positioned with respect to the thickness direction. Because the guiding pulleys 22*a*, 22*b*, 23*a* and 23*b* do not have flanges for restricting the width directional positions of the belts, wearing of the belts 13*a*, 13*b*, 14*a*, and 14*b* while rotating about the circumference of the guiding pulleys 22*a*, 22*b*, 23*a* and 23*b* do not occur, irrespective of the peripheral velocity of the guiding pulleys 22*a*, 22*a*, 23*a* and 23*b* being high in comparison to the peripheral velocities of the winding rollers 15*a*, 15*b*, 16*a* and 16*b*.

In the above-described embodiment, the support unit 10 is suspended by utilizing four belts 13*a*, 13*b*, 14*a* and 14*b*. However the number thereof is not restricted. For example, if a wide belt is utilized, it is possible to suspend the support unit 10 with two belts. Moreover, if the support unit can be suspended by one point directly above the position of the center of gravity, it is also possible to suspend the support unit using one belt. Furthermore, in a case where a plurality of belts are utilized, it is not necessary for the width directions of all of the belts thereof to be mutually parallel. Moreover, the width direction of the belts may be a horizontal direction which is perpendicular to the running direction of the traveling unit 1.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A conveying apparatus comprising:

a traveling unit which runs;

a winding roller which is supported by the traveling unit;

a belt which is wound on the winding roller so as to be unwound and wound by the winding roller;

a pulley which has a peripheral surface guiding the belt and a diameter smaller than the diameter of the winding roller; and the pulley having no flange on both ends thereof;

a belt positioning guide which is provided below the pulley and guides both edges of the belt in the width direction thereof so that the belt is positioned in the width direction; and a support unit which is attached to the belt and supports a conveyed object, wherein the belt positioning guide comprises a pair of positioning rollers holding the belt from a left side and a right side of the belt;

the pair of the positioning rollers comprising recessed grooves configured to engage with the belt from the left side and right side of the belt;

such that each recessed groove is in contact with both thick-directional corners in a side edge of the belt in each one of the pair of the rollers, and a section of the groove has an arc-like or V-like shape, and a surface portion of the belt positioning guide being in contact with the belt is composed of a synthetic resin.

* * * * *